US005287965A

United States Patent [19]

Miller

[11] Patent Number: 5,287,965

[45] Date of Patent: Feb. 22, 1994

[54] LIGHT STORAGE DEVICE

[76] Inventor: John E. Miller, 911 E. 86th St., Ste. 201, Indianapolis, Ind. 46240

[21] Appl. No.: 77,421

[22] Filed: Jun. 15, 1993

[51] Int. Cl.[5] ..... B65H 75/14

[52] U.S. Cl. ..... 206/396; 206/407; 206/420; 206/815; 242/118.8; 242/118.6; 242/85.1; 242/68.5

[58] Field of Search ..... 242/118.8, 118.4, 118.6, 242/118.61, 96, 85.1, 68.5; 206/418, 419, 420, 395, 396, 407, 413, 416, 389, 815

[56] References Cited

U.S. PATENT DOCUMENTS

| | | | |
|---|---|---|---|
| 2,532,658 | 12/1950 | Belanger | 242/118 |
| 2,714,776 | 8/1955 | Lee | 41/10 |
| 2,799,458 | 7/1959 | Nye | 242/118.8 X |
| 2,984,347 | 5/1961 | Kalinchuk | 206/65 |
| 3,085,767 | 4/1963 | Zerbest | 242/106 |
| 3,278,135 | 10/1966 | Black | 242/118.8 |
| 3,307,802 | 3/1967 | David | 242/118.8 |
| 3,310,623 | 3/1967 | Vaughan | 174/135 |
| 3,352,509 | 11/1967 | Kort | 242/118.4 X |
| 3,537,667 | 11/1970 | Dorman | 242/118.8 |
| 3,817,475 | 6/1974 | Goldstein | 242/115 |
| 3,971,527 | 7/1976 | Maye | 242/118.7 |
| 4,022,323 | 5/1977 | Yamazaki | 206/419 |
| 4,244,538 | 1/1981 | Theros | 242/118.8 |
| 4,258,847 | 3/1981 | Nierman | 206/504 |
| 4,492,350 | 1/1985 | Dgetluck | 242/118.4 |
| 4,493,462 | 1/1985 | Ditton | 242/118.61 |
| 4,542,862 | 9/1985 | Romike et al. | 242/96 |
| 4,735,314 | 4/1988 | Kadleck et al. | 206/426 |
| 4,917,323 | 4/1990 | Wing | 242/96 |

*Primary Examiner*—Paul T. Sewell
*Assistant Examiner*—Jacob K. Ackun, Jr.
*Attorney, Agent, or Firm*—Baker & Daniels

[57] ABSTRACT

A storage device for storing Christmas lights assembled from a vertical core section, a pair of horizontal end sections, and a sheath. The device is constructed from corrugated cardboard. Each opposing end of each of the four sides of the core section includes both a foldable flap and a slot, which is formed adjacent the fold line of the flap. The horizontal end sections, located at either opposing core section end, each include a centrally disposed opening defined by four inward sides. Each inward side has a width substantially equal to the core section sides and includes an inwardly extending tab. When the core section is inserted into the centrally disposed opening, the tabs are received by the slots to secure the core section and end section together. Each end section also includes four locking regions, each locking region having a first folding element and a second folding element. The first folding element folds toward the far surface of the end section such that it overlays the core section flap outwardly folded against the end section. The second folding element then folds into the hollow center of the core section. The core section and end section are thereby further secured together. The sheath encloses and protects articles wound around the assembled core section and end sections during storage.

12 Claims, 8 Drawing Sheets

LIGHT STORAGE DEVICE

FIELD OF THE INVENTION

This invention relates to storage devices, and, in particular, to a storage device for articles such as Christmas lights which are conducive to being wound up and stored for future use.

BACKGROUND OF THE INVENTION

A large segment of the world's population experiences Christmas—a time of year replete with a variety of traditions and rituals. One very traditional task performed in preparation for Christmas and the holiday season involves stringing lights around the house and on the Christmas tree. A display of festive lights not only advances the spirit of the season, but also prompts fond memories for most observers. Unfortunately, all too often the person responsible for stringing the lights will be less than completely pleased with the memories prompted by the lights. These tainted memories result from an assortment of difficulties frequently encountered in performing this task. In addition to battling the elements, the person stringing the lights must also overcome the complications created by the light removal and storage techniques utilized the previous year. Invariably, light bulbs have been crushed during storage and the electric cord is seemingly hopelessly tangled. The correction of these problems is an exasperating chore, and requires a fair amount of time so precious during the fleeting holiday season.

Attempts to minimize the difficulty of stringing lights in any given year are likely to fail due to the timing wherein they must be effectuated. Preventative measures must be taken almost a full year before the fruits of the painstaking light removal and storage efforts are realized. Moreover, after an exhausting holiday season, little energy is left to insure that the lights are properly stored for the next year. And naturally, there is always a possibility that the person removing the lights is aware, whether it be consciously or otherwise, that someone else will be charged with stringing the lights the following year.

Existing solutions to storing Christmas tree lights are inadequate for a variety of reasons. Many people simply coil the lights like a rope and bind them together with the light cord. In the short run, this light storage technique is quick and effective. However, the exposure of the bulbs to external forces and the resulting bulb breakage during the initial storing and year long storage makes such a storage technique less than ideal. In addition, the stringing of the lights around a tree the following year is made awkward. Prior to beginning, the string of lights must be straightened to ensure that no knots in the cord are present. Otherwise, if after beginning the stringing process a tangled cord is discovered, a person stringing the lights may be forced to cease the decorating process and remove the light string so the knot can be unraveled. Then, because the lights are already straightened and rest on the ground, each light must be individually secured to the branches of the tree. If a person attempts to simply place the lights on top of the branches without securing the lights thereto, the weight of the remaining lights not yet hung may pull down these placed lights. Other people attempt to replace the lights in the original packaging from which they came. However, those who have opted to use this method of light storage can describe the daunting task of reinserting a mass of disorganized lights and cords into the tight and orderly arrangement from which they were removed. U.S. Pat. Nos. 4,917,323 and 2,984,347 disclose devices for use in storing Christmas tree lights. Similar to the problem encountered in storing Christmas tree lights in the package from which they came, orienting the lights in these storage devices is time consuming and therefore undesirable. Moreover, no protection of the lights and cord from outside forces acting against the lights during initial storing and year long storage is provided.

OBJECTS OF THE INVENTION

Accordingly, one object of the invention to provide a storage device, for articles wound for storage such as Christmas tree lights, which can be inexpensively manufactured from lightweight material, such as corrugated cardboard.

Another object of the invention is to provide a storage device that can be marketed in its disassembled state as a relatively flat unit, thereby requiring minimal amounts of store shelf storage and display space.

Another object of the invention is to provide a storage device, assembled from multiple corrugated cardboard pieces, which uses a double locking attachment between the separate pieces to both guarantee the pieces remain together without extra fasteners as well as provide desirable extra rigidity and durability to the device.

A still further object of the invention is to provide a storage device for Christmas lights which facilitates the stringing and subsequent removal of the lights.

A still further object of the invention is to provide a storage device for Christmas lights which makes quicker the stringing of lights by eliminating the need to individually secure each light to a branch of the Christmas tree during the light stringing process.

A final object of the invention is to provide a storage device for Christmas lights which prevents bulb breakage and light cord entanglement during both their initial storing process and year long storage.

SUMMARY OF THE INVENTION

In one form thereof, the light storage device of the present invention, which is for use with articles wound for storage such as Christmas lights, comprises a vertical core section, a pair of horizontal end sections, and a sheath. The core section includes opposing ends, a plurality of sides defining a hollow center, and an ends connecting core length formed by the sides. At each opposing end of the core section, at least one of the core section sides further comprises a flap and a slot. The flap is outwardly foldable along a fold line away from the core center, and the slot is formed adjacent the fold line of the flap. The horizontal end sections, one of which is located at either opposing end of the core section, each include a near surface and a far surface relative to the core section length as well as a centrally disposed opening defined by a plurality of inward sides. The inward sides are in a one to one correspondence with the core section sides. Each inward side corresponding to the core section side having the foldable flap further comprises an inwardly extending tab received by the slot of the corresponding core section side. This tab and slot engagement secures or locks the core section and end section together. Each end section further comprises at least one outward locking region corresponding to the inward side having the inwardly extending tab. The locking region includes a first folding element and a second folding element. The first folding element folds toward the far surface of the end section such that it overlays the core section flap outwardly folded against the far surface of the end section, and the second folding element folds into the core section center, thereby further securing the core section and end sections together. The sheath encloses and protects articles wound around the core section.

In another form of the invention, in addition and with reference to the elements listed in the form of the invention described above, each of the core section sides includes a flap, outwardly foldable along a fold line away from the core center. Each end section includes a plurality of locking regions and a plurality of outward sides. The locking regions, which each have a first folding element and a second folding element, are in a one to one correspondence with the core section sides. The second folding elements include extending securing tabs or recesses which engage when the end section is assembled to maintain the second folding elements in the core section center. The outward sides are in a one to one correspondence with the core section sides. One of the end sections also includes an article end receiving slot formed in an outward side, as well as a finger sized notch formed in two opposing outward sides.

DETAILED DESCRIPTION

A preferred embodiment of the light storage device of the present invention shown in the Figures is essentially assembled from four separate parts inexpensively constructed or die-cut from flat pieces or blanks of corrugated cardboard. These parts, which are shown in their unfolded and unassembled flat condition in FIG. 1, FIG. 3, and FIG. 6, include a single vertical core section, generally designated 10, a pair of identically shaped opposing horizontal end sections, generally designated 40, 41, and a single sheath, generally designated 70, respectively.

Figure 1:
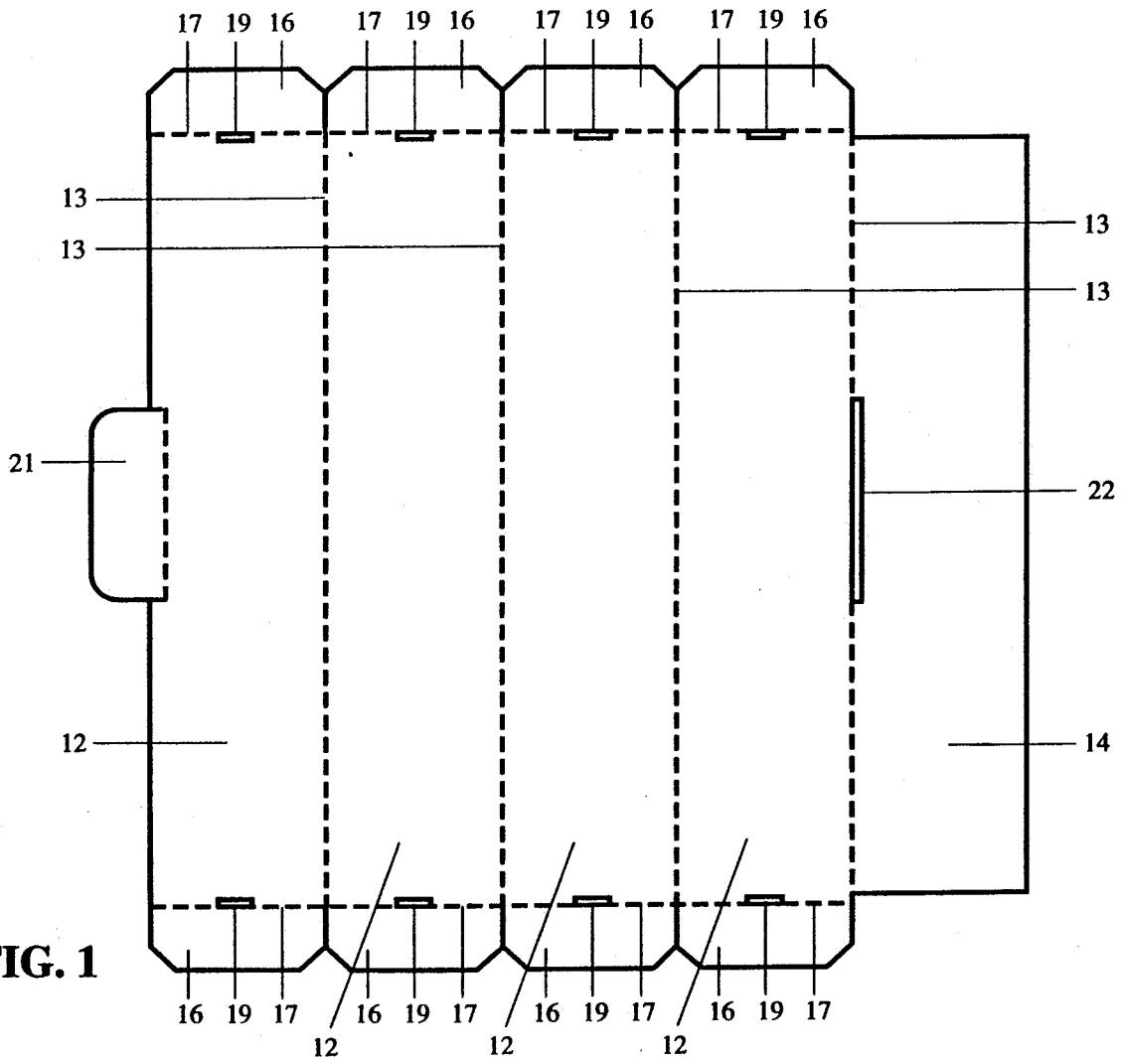
FIG. 1 shows a front view of the unfolded core section of one embodiment of a storage device according to the present invention.
Figure 2:
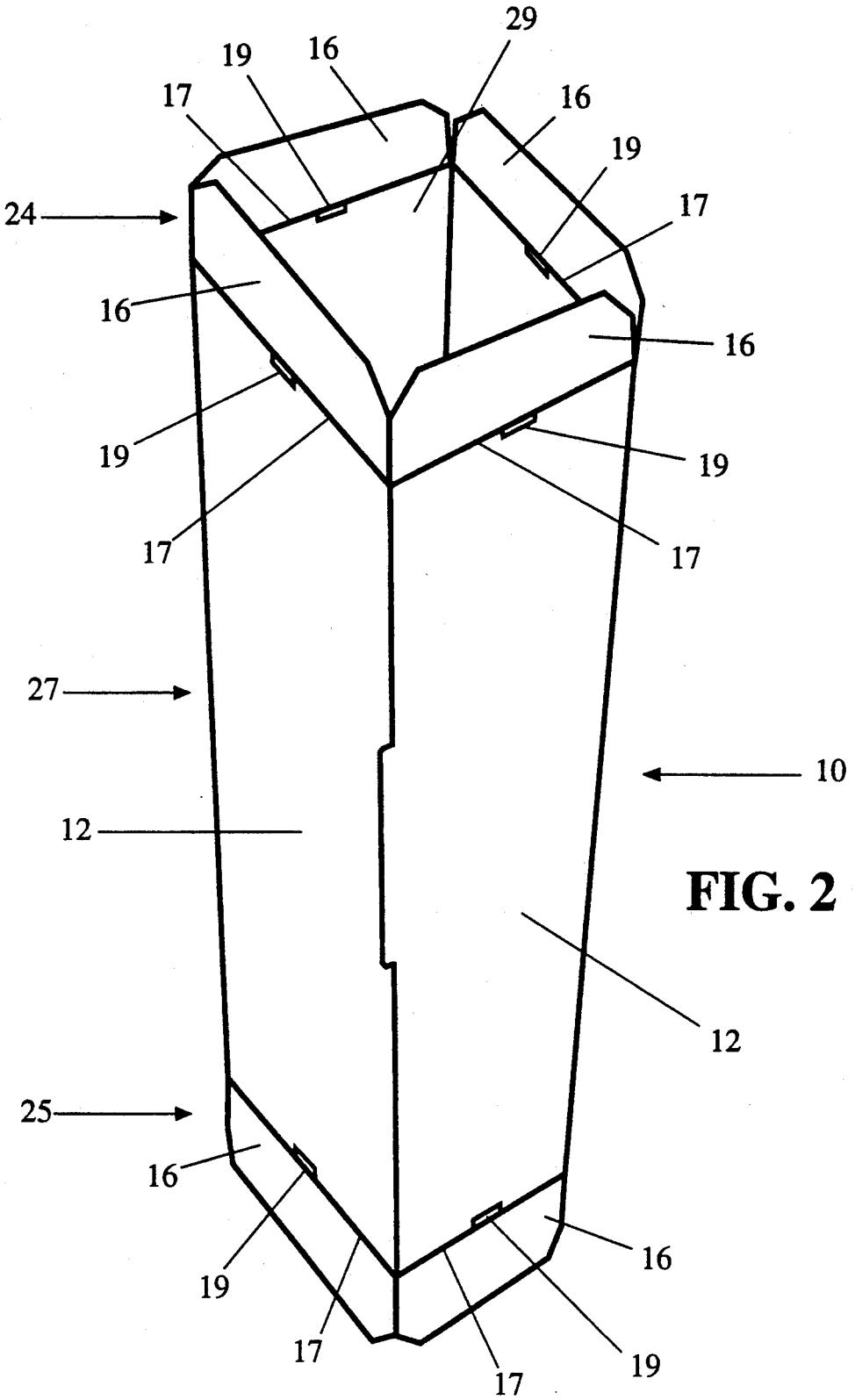
FIG. 2 shows a perspective view of the core section of FIG. 1 after it has been folded and assembled.

Referring now to FIG. 1 and FIG. 2, vertical core section 10 comprises four rectangular shaped core section sides 12 of similar height and width and reinforcing member 14, which is of slightly reduced height and width in comparison to sides 12. Side bend lines 13 extend along the intersection of sides 12 as well as the intersection of side 12 with reinforcing member 14. Bend lines 13 are perforated, but alternatively could be scored or merely precreased, to facilitate accurate bending and thereby ensure that core section 10 will be properly square after assembly. All of the fold lines illustrated in the Figures are shown and described as perforated, but similarly could be scored or precreased where suitable. Each rectangular shaped side 12 terminates at its top and bottom, or more particularly along its short edges, with flap 16. Flap 16 is foldable along perforated flap fold line 17. Formed adjacent fold line 17 and in the center of each short edge of each side 12 is a horizontal slot 19 utilized in the locking attachment of horizontal end sections 40, 41 to core section 10. The uppermost limit of the slot formed at the top of each side 12, and the lowermost limit of the slot formed at the bottom of each side 12, are bounded by fold lines 17. As shown in FIG. 1, a sideways extending core tongue 21 is formed halfway up the left edge of the left most core section side 12. A mating or receiving core groove 22 is correspondingly sized and positioned along the bend line 13 located between the right most core section side 12 and reinforcing member 14.

To assemble core section 10 as shown in FIG. 2, reinforcing member 14 is first bent 90° into the paper of FIG. 1 along bend line 13. Each side 12, proceeding from right to left in FIG. 1, is then similarly bent 90° into the paper of FIG. 1 along bend lines 13. During the bending of sides 12 along the left most bend line 13, core tongue 21 should be bent 90° into the paper in order to be fully inserted into core groove 22 after completion of the core section bending process. After proceeding in this manner, core section 10 is securely maintained in a configuration having a hollow center 29 with a square cross-section defined by sides 12 as shown in FIG. 2. Reinforcing member 14 is disposed within the four-sided core section 10 and contacts the inner surface of the left most side 12 of FIG. 1, thereby providing a double thickness thereat for increased structural rigidity. Inherent in assembled core section 10 and specified to simplify explanation, core section 10 includes opposing top end 24 and bottom end 25 which are connected by an ends connecting core section length 27 formed by sides 12.

Figure 3:
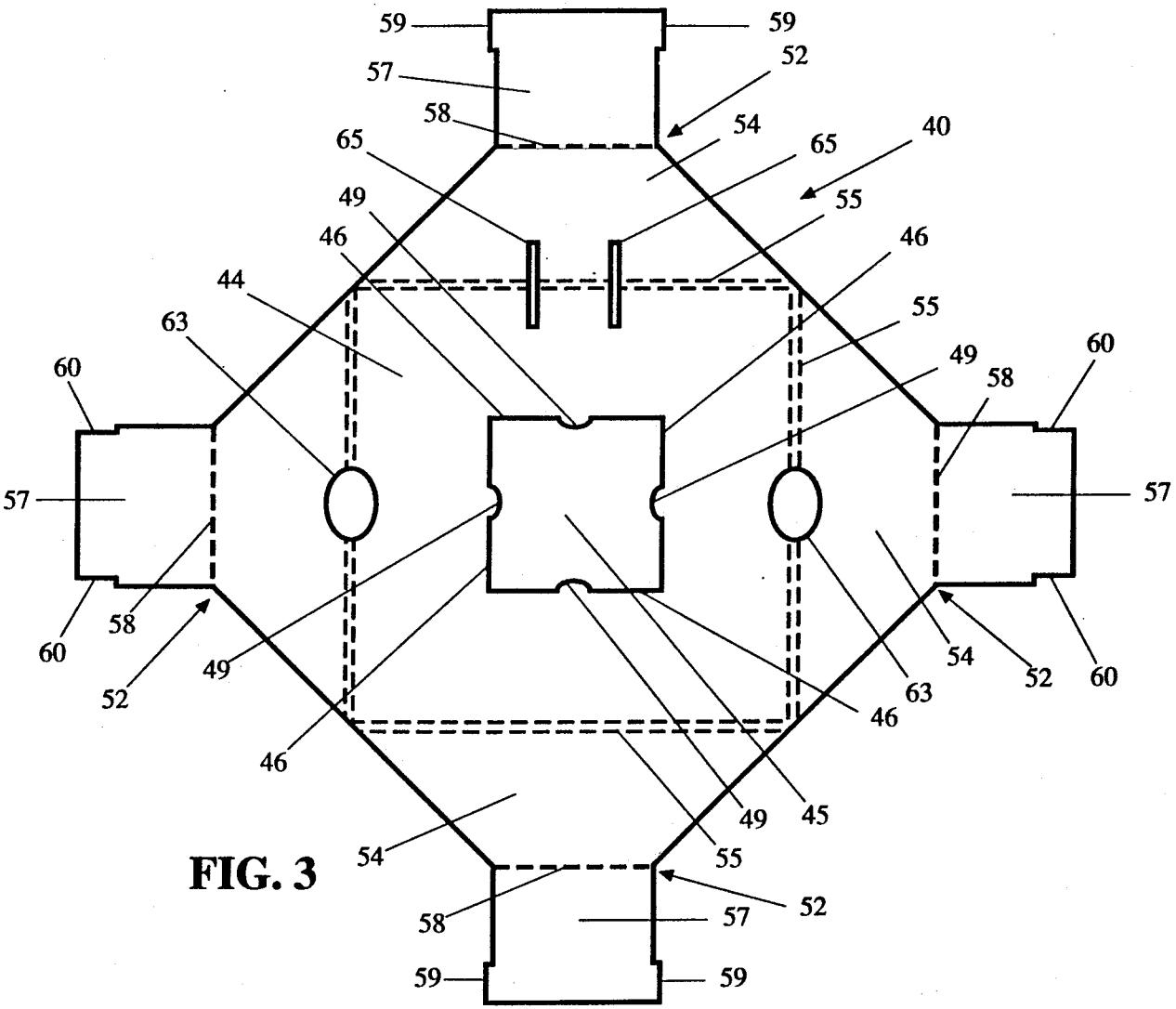
FIG. 3 shows a top view of one of the end sections, in its unfolded condition, which is used in conjunction with the core section of FIG. 2.

Referring now to FIG. 3, there is shown a top view of the unfolded horizontal top end section 40, which is similar to horizontal to core section 10. End section 40 includes a generally square centrally disposed opening 45 which is defined by four inward sides 46 of end section 40. Inward sides 46, which are in a one to one correspondence with core section sides 12, each have a width substantially equal to core section side 12. In other words, inward sides 46 are only slightly larger in length than the short edges of sides 12 and allow four-sided core section 10 to closely fit within centrally disposed opening 45. Moreover, each inward side 46 includes a centrally located inwardly extending tab 49 which, as will be described presently, serves as a means of locking or securing end section 40 to top end 24 of core section 10. End section 40 further includes far surface 44 and a near surface (not shown as it is on the opposite side of end section 40) relative to core section length 27, as well as four outward locking regions, generally designated 52. Far surface 44, outwardly bounded by perforated double fold lines 55 and inwardly bounded by inward sides 46, is generally a square ring in shape. A portion of far surface 44 is die-cut from three of its outer boundaries during fabrication to provide holes 63 and slots 65. Holes 63, which serve as finger notches after assembly of end section 40, are located along and centered on double fold lines 55 on opposing sides of end section 40. Slots 65, which after assembly of end section 40 serve as article end receiving slots for articles wound around the invention, are located along and bisected by another double fold lines 55.

Each locking region 52 comprises a first foldable element 54 and a second foldable element 57. First foldable element 54 is trapezoidal in shape, except for any portion possibly precut therein to provide holes 63 and slots 65. The inward side of each element 54 is defined by double fold lines 55. Therefore, each element 54 is foldably attached to an outer side of square ring shaped far surface 44. The outward side of each element 54 is defined by perforated fold line 58. The remaining two mirror image angled sides are not attached with any other portion of end section 40. Second folding element 57 is substantially rectangular shaped and is disposed outward of first folding element 54 and attached thereto along fold line 58. Laterally disposed at the outward most corners of each second folding element 57 are securing means which assist in maintaining end section 40 in an assembled condition as will be described presently. The securing means of one set of opposing second folding elements 57 comprise extending securing tabs 59, and the means for the other set of opposing elements 57 comprise securing recesses 60. More generally, and from a clockwise perspective of FIG. 3, alternating second folding elements 57 have the extending securing tabs 59, and the other alternate elements 57 each have the securing recesses 60.

Figure 4:
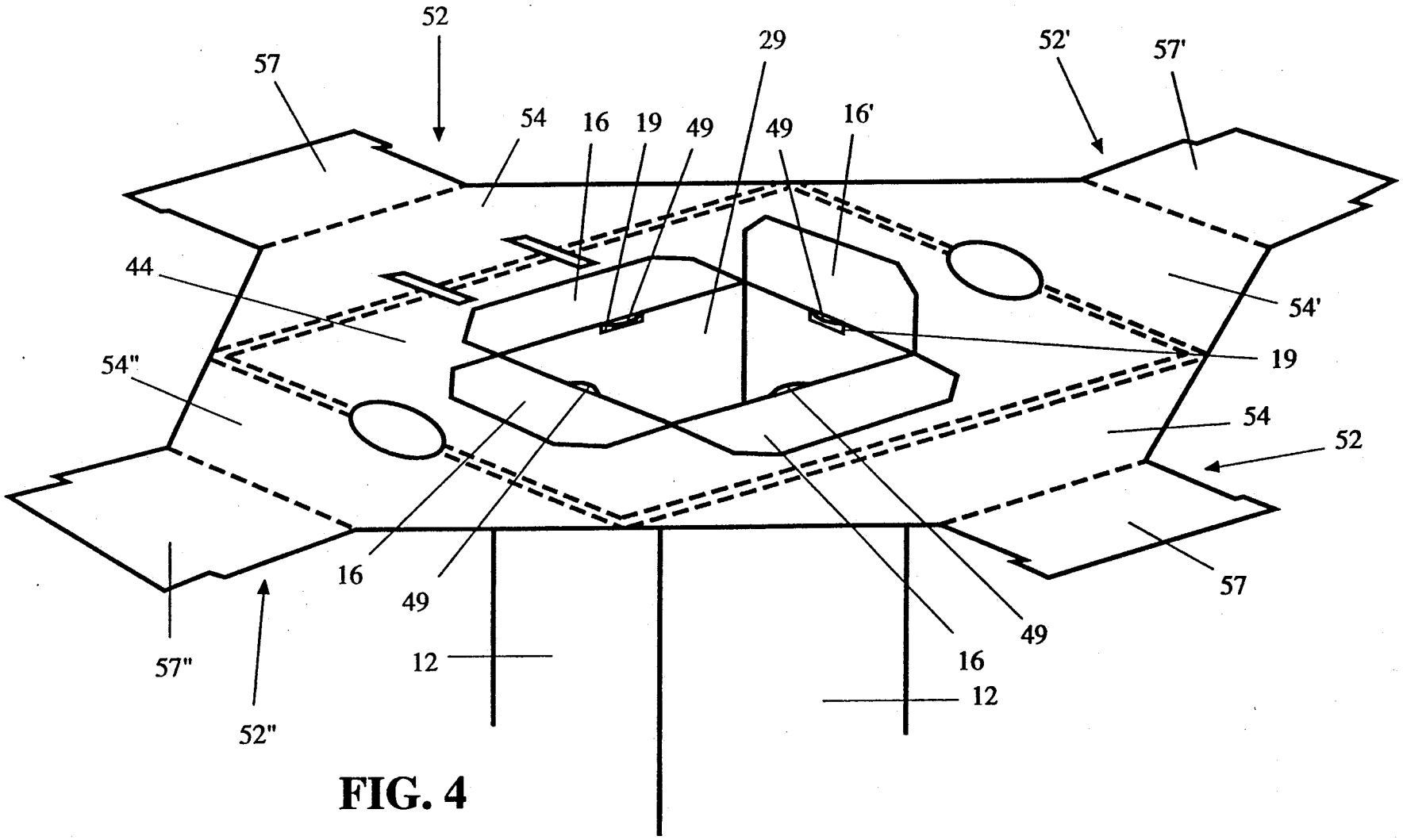
FIG. 4 shows a perspective view of one end of one embodiment of the present invention wherein the end section and core section are first locked together.
Figure 5:
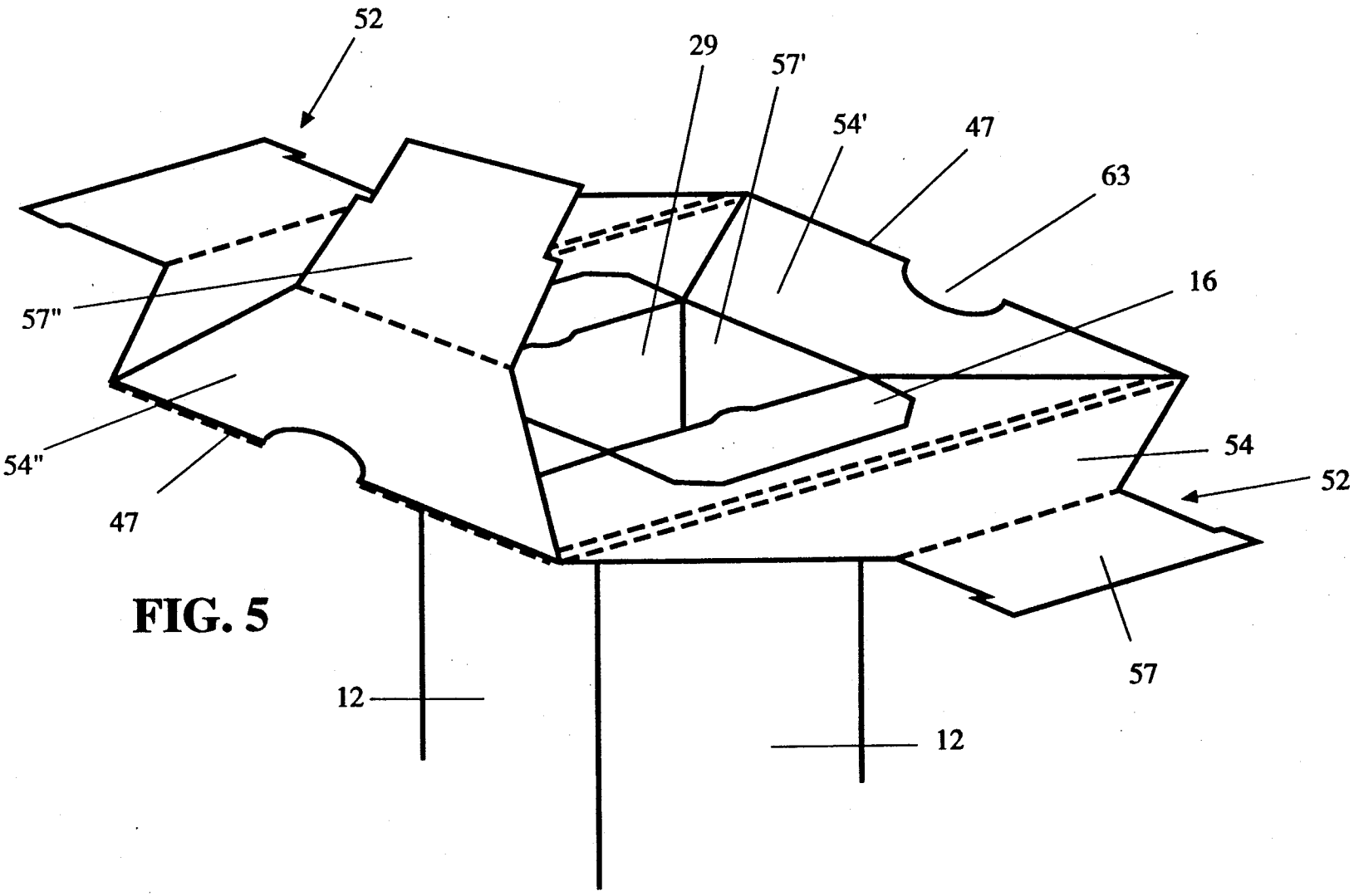
FIG. 5 shows the configuration of the embodiment shown in FIG. 4 after one locking region has been fully folded to further lock the end section to the core section, and another locking region is shown partially moved into the locking position.

With reference to FIG. 4 and FIG. 5, horizontal end section 40 is attached and assembled to top end 24 of vertical core section 10 in the following manner, and, although illustrated with reference to end section 40, horizontal end section 41, located at the opposing end or bottom end 25 of core section 10, is similarly attached. First, while maintaining flaps 16 vertically or slightly inwardly disposed, top end 24 (FIG. 2) is aligned and inserted from behind the page of FIG. 3 into centrally disposed opening 45 of horizontal end section 40. Core section 10 is then moved upwardly until inwardly extending tabs 49 are aligned with and received by horizontal slots 19 of sides 12. Reinforcing member 14 is of sufficient reduced height from the height of side 12 so as not to interfere with this tab insertion. Because the separate parts have been accurately fabricated such that each inward side 46 is only slightly longer than the short edges of sides 12, tabs 49 frictionally contact any vertically disposed flaps 16 during insertion of core section 10 and also, with minor alignment adjustment, automatically insert into slots 19. Through this tab and slot engagement, end section 40 is secured or locked to core section 10 and relative vertical motion between the two sections is prevented. Flaps 16 are then outwardly folded away from hollow center 29 along flap fold lines 17 toward far surface 44 of end section 40. In FIG. 4, three flaps 16 are shown after being folded outward to a horizontal orientation against end section 40. Flap 16', shown still in a vertical orientation, will be folded outward to a horizontal orientation before assembly continues.

After flap 16' is folded outward, the locking regions 52 of FIG. 3 are then utilized to further secure end section 40 to core section 10. First, and as labeled in FIG. 4, first folding element 54' of locking region 52' is folded along double fold lines 55 upward from a horizontal orientation and then down toward far surface 44. After being so folded approximately 180° from its initial position, first folding element 54' overlays and contacts flap 16' as well as overlays and covers one quarter of the area of square ring shaped far surface 44. The provision of double fold lines 55, rather than a single fold line, better allows the 180° folding. Outward side 47 (FIG. 5), identifiable when first folding element 54' is in its folded position, is parallel to core section side 12 and inherently has a height dimension equal to the space between the perforated lines of double fold lines 55. Second folding element 57' of locking region 52', as a result of the pivoting of first folding element 54', now extends over hollow center 29. Second folding element 57', which includes securing recesses 60, is then folded approximately 90° downward and into hollow core center 29. Locking region 52", which is sized and shaped identical to locking region 52', is then similarly assembled. FIG. 5 illustrates this stage of the assembly process wherein first folding element 54" and second folding element 57" have already been folded upward and are now being folded down toward far surface 44. The remaining locking regions 52, which include securing tabs 59 on second folding elements 57, are then assembled in the identical manner. After each second folding elements 57, 57', 57" is folded downward into hollow center 29, and the assembler of the invention ensures tabs 59 have been fit into recesses 60, securing tabs 59 and securing recesses 60 engage to maintain the second folding elements together and within hollow center 29 of vertical core section 10. Various other means of keeping or holding the second folding elements within hollow center 29 are envisioned which can readily be employed. For instance, the second folding elements could be sized and shaped to frictionally engage the inner surfaces of core section sides 12, or could be shaped to cooperate with recesses formed in sides 12. As a result of the second folding elements being maintained within hollow center 29, end section 40 is thereby further locked or secured to core section 10. Specifically, all the flaps 16, 16' are locked tightly between far surface 44 and first folding elements 54, 54', 54", which in turn are held in position by the engaged second folding elements. Therefore, end section 40 is further prevented from moving vertically relative to core section 10.

After properly assembling into their folded and secured to core section 10 positions, end sections 40, 41 are square and each comprise four outward sides 47. Far surface 44 has also been completely covered by the four first folding elements. In two opposing outward sides 47 of each end section 40, 41, and preferably in alignment, finger sized notches 63 are located. Along a third outward side 47 of each end section 40, 41 is located two parallel and outwardly directed slots 65 which can receive the ends of the articles wound around the invention, such as a light cord of wound Christmas lights.

Figure 6:
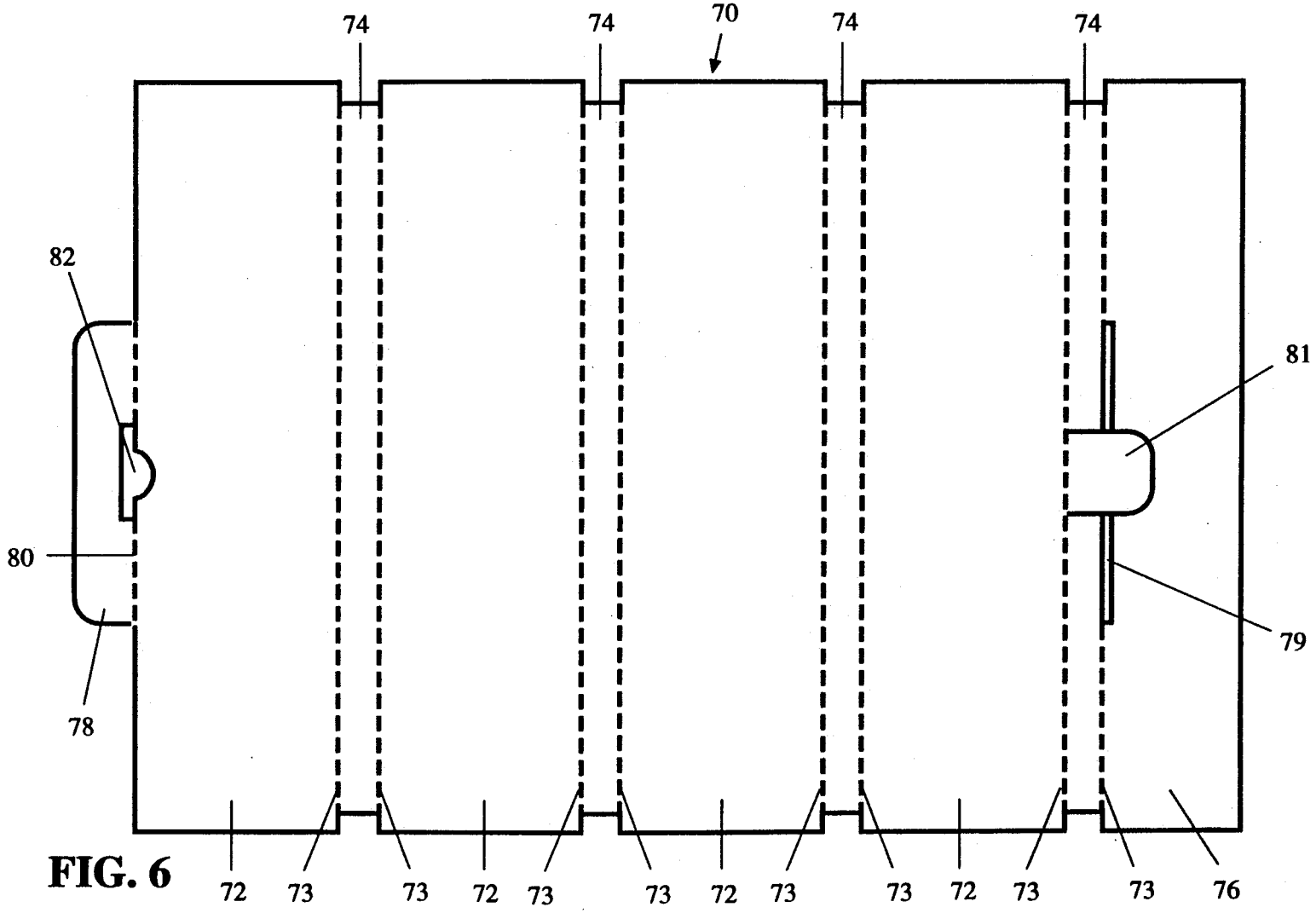
FIG. 6 shows a front view of the protective sheath, in its unfolded condition, utilized with the embodiment of the storage device shown in the above FIGS. 1-5.

Referring now to FIG. 6, there is shown the final part of the invention. Constructed to fit closely around the assembly of core section 10 and end sections 40, 41 and thereby enclose and protect articles wound around core section 10, protective sheath 70 includes four identical rectangularly shaped protective sides 72. Each protective side 72 is sized to be less wide than outward side 47, as well as greater in height than the assembly of core section 10 and end sections 40, 41. Sheath reinforcement member 76 is of similar height but of lesser width than protective side 72. A total of four corner sides 74 are located either between adjacent protective sides 72 or between the right most protective side 72 and reinforcement member 76. Each corner side 74 is of a height approximately equal to the vertical distance between the near surfaces of the opposing end sections 40, 41. Perforated sheath fold lines 73 are located along the lines of intersection of corner sides 74 with protective sides 72 or reinforcement member 76. Sheath tongue 78 laterally extends from the left most protective side 72 shown in FIG. 6, and is foldable along line 80. Locking tongue mate hole 82 is formed in sheath tongue 78 and is integral with a finger notch formed in protective side 72. Sheath groove 79, corresponding in size to tongue 78, is formed within reinforcement member 76 adjacent fold line 73. Laterally oriented locking tongue 81, which inserts into locking tongue mate hole 82 to lock sheath 70 in a closed position, originates in the right most corner side 74 and is formed from a central portion of both the right most corner side 74 and reinforcement member 76.

Figure 7:
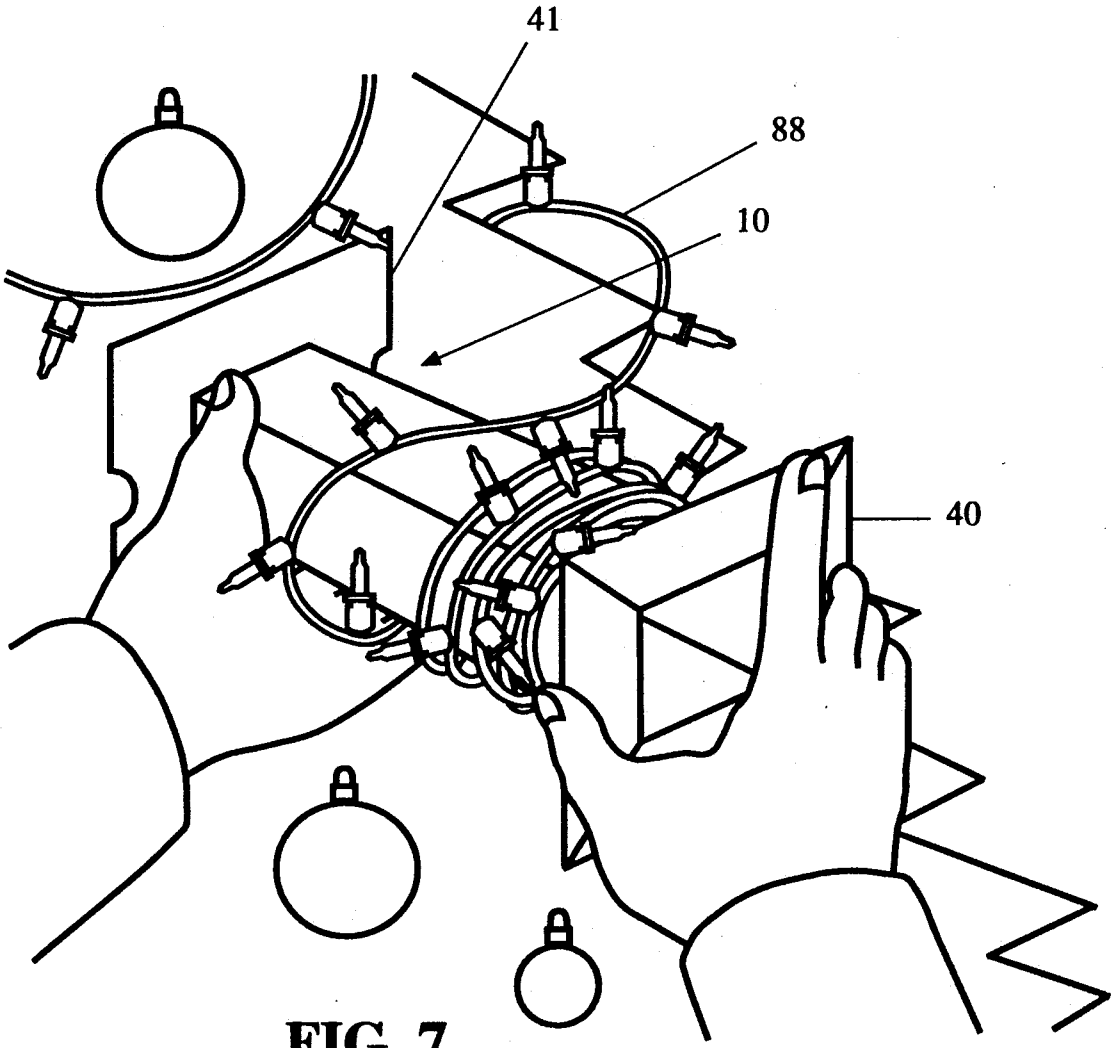
FIG. 7 shows a perspective view of the present invention after assembly and in operation with a strand of Christmas tree lights winding around the core section, wherein the invention is being utilized to either remove or string Christmas lights on a tree.

After attaching and assembling end sections 40, 41 to core section 10, the invention is ready for operation. In practice, the invention functions as a storage device for many different types of articles wound for convenient storage. However, the task for which the invention was particularly designed and for which it finds highly useful application is the storage of Christmas lights and holiday trimming items such as garland. When removing a string of Christmas lights 88 from, for example, a Christmas tree, a user of the invention can first insert the light cord proximate the plug into cord slot 65 and wrap the remainder of the cord around core section 10. Then, while grasping either end section 40, 41 with one hand and core section 10 with the other as shown in FIG. 7, or alternatively employing both hands to grasp the finger notches 63 on both end sections 40, 41, the invention can be rotated. The rotation wraps the Christmas lights and cord along the ends connecting core length 27 as shown in FIG. 7. During this removal and wrapping of lights around core section 10, and depending on the manner in which the lights were strung, the user merely needs to walk around the tree or otherwise follow the string of lights while rotating the invention until the lights are totally wound up. The cord near the outermost light can then be inserted into cord slot 65. In order to install the lights the following year, the user merely needs to remove the end of the light strand located in slot 65, fasten the end to the tree, and reverse the above described winding process. Note that light strand entanglement problems have been eliminated and installation is thereby simplified.

Figure 8:
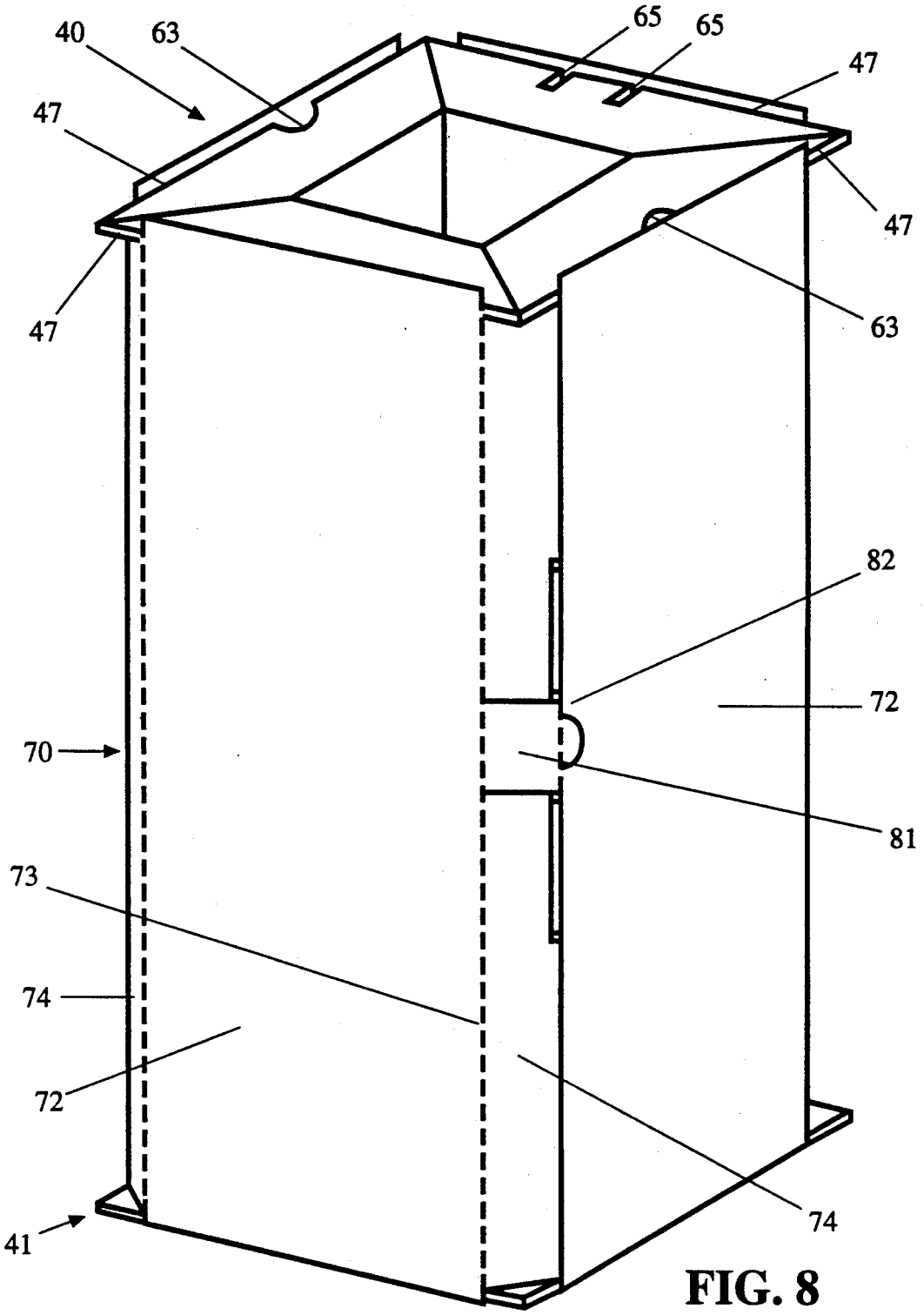
FIG. 8 shows a perspective view of the present invention wherein the sheath encloses any articles wound around the fully assembled embodiment of the storage device shown in the above FIGS. 1-5.

After being wound around the invention, the Christmas lights are then ready for storage. The core section 10 and end sections 40, 41 assembly with the wound lights could simply be introduced into a conforming and appropriately sized box for safe storage until the following year. However, during introduction into the box, the possibility exists that some light bulbs which were inadvertently left extending beyond the plane of the outward sides 47 may be trapped between the edge of the box and outward side 47 and thereby damaged. Sheath 70 is provided to eliminate any chance of this undesirable incident occurring. After placing the core section 10 and end sections 40, 41 assembly with the wound lights behind sheath 70 of FIG. 6, sheath 70 is folded around the assembly by bending each protective side 72 and reinforcement member 76 45° into the page relative to corner sides 74 and along fold lines 73, making sure member 76 is inside the resulting substantially square shaped enclosure. Each protective side 72 abuts and covers an outward side 47 of both end sections 40, 41. The corners of end sections 40, 41 extend over corner sides 74. After sheath 70 has been gently tightened around the assembly, thereby delicately compressing the wound lights together, sheath tongue 78 is inserted into sheath groove 79. Then, locking tongue 81 is inserted into mate hole 82, thereby further ensuring sheath 70 will not come open. This final storage configuration of the invention is shown in FIG. 8. Now, the invention can quickly be placed into a box without fear of breaking any lights due to the presence of sheath 70, which also provides an additional layer of material around the lights for greater protection during storage. Therefore, sheath 70 provides further light protection both during the initial storing process as well as during the year long storage period.

While the above description teaches the use of storage device wherein the core section, end sections, and sheath are each substantially four sided, the invention is not intended to be limited to such a configuration. Those of skill in the art will understand that alternative embodiments having a plurality of sides, three or more in number, can be constructed using the teachings of the invention to produce storage devices having different shapes, and are considered within the scope of the invention. Moreover, a number of modifications to the taught design are foreseen which still provide a workable embodiment. For example, although the integrity of the attachment between parts and rigidity of the invention is reduced, each side 12 need not include flap 16, slot 19, and have a corresponding inward tab 49 and locking region 52 formed in end section 40, 41. Moreover, the sides of the invention need not be identically sized provided corresponding changes in all the parts are made.

As will be appreciated by those of skill in the art in view of the foregoing disclosure, the present invention provides a useful storage device for articles wound for storage such as Christmas lights. Because of its construction from corrugated cardboard, the storage device is lightweight as well as inexpensively manufactured. As the storage device is constructed from flat pieces of material and is easily and quickly assembled by a user, the invention can be marketed in its disassembled state as a relatively flat unit which requires minimal amounts of valuable store shelf storage and display space. The invention also utilizes a double locking attachment between the end sections and the core section. Specifically, inward tabs 49 combine with slots 19 to provide one locking attachment between the pieces. And, the retention of the outwardly foldable flaps 16 between far surface 44 and the first folding elements provides both another locking attachment between the pieces as well as an effective increased thickness and rigidity to end sections 40, 41. Thus, this double locking attachment ensures that the end sections and core section remain together without extra or external fasteners as well as provides desirable extra rigidity and durability to the device. Finally, in practical application, the storage device facilitates the stringing and subsequent removal of Christmas lights, and also the storage of the lights or any other wound article. For example, stringing the lights is greatly simplified because the entire strand of untangled lights is orderly and conveniently located around the storage device, which allows a user to easily transport and handle the lights. Also, because the lights not yet strung are effectively supported by the user, their weight does not act to pull down the lights already strung. All the lights in the strand can therefore by hung quickly and easily by, for example, placement on the branches of a Christmas tree without individual securement thereto. The time required to string the lights is greatly reduced by the invention. And, because the sheath encloses the lights wound around the core section, the storage device prevents bulb breakage during both their initial storing process and year long storage.

What is claimed is:

1. A storage device, for use with articles wound for convenient storage such as Christmas lights, comprising:

a vertical core section having opposing ends, a plurality of sides defining a hollow center, and an ends connecting core length formed by the sides, wherein at each opposing end at least one of the core section sides further comprises a flap, outwardly foldable along a fold line away from the core center, and a slot formed adjacent the fold line of the flap, a pair of horizontal end sections, one located at either opposing end of the core section, each having a near surface and a far surface relative to the core section length, each end section further comprising a centrally disposed opening defined by a plurality of inward sides, the inward sides being in a one to one correspondence with the core section sides, wherein each inward side corresponding to the core section side having the foldable flap further comprises an inwardly extending tab received by the slot of the corresponding core section side to secure the core section and end section, each end section further comprising at least one outward locking region having a first folding element and a second folding element, wherein the first folding element is folded toward the far surface of the end section such that it overlays the core section flap outwardly folded against the far surface of the end section, and the second folding element folds into the core section center, thereby further securing the core section and end section together.

2. The storage device of claim 1 wherein each of the core section sides further comprises a flap, outwardly foldable along a fold line away from the core center, and each end section further comprises a plurality of locking regions having a first folding element and a second folding element, the locking regions being in a one to one correspondence with the core section sides.

3. The storage device of claim 2 wherein each end section further comprises a plurality of outward sides, the outward sides being in a one to one correspondence with the core section sides.

4. The storage device of claim 3 wherein the second folding elements include extending securing tabs or recesses, in alternating elements, which maintain the second folding elements in the core section center.

5. The storage device of claim 4 wherein at least one end section further comprises at least one article end receiving slot formed in the outward side.

6. The storage device of claim 5 further comprising a finger sized notch in at least two opposing outward sides of one of the end sections.

7. The storage device of claim 6 further comprising a sheath enclosing and protecting articles wound around the core section.

8. The storage device of claim 7 wherein the vertical core section, each horizontal end section, and the sheath are formed from flat pieces of corrugated cardboard and can be oriented in a disassembled state as a relatively flat unit.

9. The storage device of claim 1 wherein the core section has a square cross-section and the end sections, in their folded and secured to the core section position, are square.

10. A storage device for storing Christmas lights, formed from corrugated cardboard blanks, the device comprising:

a vertical core section having opposing ends, four sides defining a hollow center, and an ends connecting core length formed by the sides, wherein at each opposing end each core section side further comprises a flap, outwardly foldable along a fold line away from the core center, and a slot formed adjacent the fold line of the flap, a pair of horizontal end sections, one located at either opposing end of the core section, each having a near surface and a far surface relative to the core section length, each end section further comprising a centrally disposed opening defined by four inward sides of a width substantially equal to the core section sides, wherein each inward side further comprises an inwardly extending tab received by the slot to secure the core section and end section together, each end section further comprising four locking regions, each locking region having a first folding element and a second folding element, wherein each first folding element is folded toward the far surface of the end section such that it overlays the core section flap outwardly folded against the end section, and each second folding element folds into the core section center, thereby further securing the core section and end section together, wherein the second folding elements of one set of opposing locking regions include extending securing tabs, and the second folding elements of the other set of opposing locking regions include securing recesses, the securing tabs and recesses engagable to maintain the second folding elements in the core section center, each end section having four outward sides, at least one end section further comprising a light cord receiving slot formed in one of the outward sides of an end section, and a finger sized notch in two opposing outward sides of one of the end sections.

11. The storage device of claim 9 further comprising a sheath for enclosing and protecting articles wound around the core section.

12. The storage device of claim 11 wherein the vertical core section, each horizontal end section, and the sheath are formed from flat blanks and can be oriented in a disassembled state as a relatively flat unit.

* * * * *